United States Patent [19]

Orban

[11] Patent Number: 4,645,573

[45] Date of Patent: Feb. 24, 1987

[54] CONTINUOUS PROCESS FOR THE SEQUENTIAL COATING OF POLYESTER FILAMENTS WITH COPPER AND SILVER

[75] Inventor: Ralph F. Orban, Columbus, Ohio

[73] Assignee: Material Concepts, Inc., Columbus, Ohio

[21] Appl. No.: 729,773

[22] Filed: May 2, 1985

[51] Int. Cl.[4] ..... C23C 18/30

[52] U.S. Cl. ..... 204/14.1; 8/139; 427/305; 427/306; 427/307; 427/322; 204/21; 204/38.4; 204/40

[58] Field of Search ..... 427/304, 306, 322, 307; 428/263; 8/139; 204/14.1, 21, 38.4, 40

[56] References Cited

U.S. PATENT DOCUMENTS

| | | | |
|---|---|---|---|
| 3,666,550 | 5/1972 | Okuhashi | 428/263 |
| 3,686,019 | 8/1972 | Ohfuka | 427/304 |
| 3,967,010 | 6/1976 | Maekawa | 427/306 |
| 4,002,779 | 1/1977 | Nischwitz | 427/305 |
| 4,278,435 | 7/1981 | Ebneth | 427/305 |
| 4,340,382 | 7/1982 | Morlino | 252/8.9 |
| 4,374,893 | 2/1983 | Arsac | 427/304 |

FOREIGN PATENT DOCUMENTS

| | | | |
|---|---|---|---|
| 2749151 | 5/1979 | Fed. Rep. of Germany | 427/306 |
| 2820525 | 11/1979 | Fed. Rep. of Germany | 427/304 |
| 3146235 | 5/1983 | Fed. Rep. of Germany | 428/263 |
| 3243190 | 5/1984 | Fed. Rep. of Germany | 427/304 |
| 50-31197 | 3/1975 | Japan | 427/306 |
| 52-59800 | 5/1977 | Japan | 427/306 |
| 58-171419 | 10/1983 | Japan | 427/304 |

*Primary Examiner*—John D. Smith
*Attorney, Agent, or Firm*—John L. Gray

[57] ABSTRACT

A method of continuously sequentially coating polyester with copper and silver which utilizes as a key step in the process the use of a wetter solution containing alcohol, a detergent and an ethylene oxide and propylene oxide copolymer surfactant. The filaments are in the form of multi-filament tows, roving, woven tape or fabric and the steps involve immersing the filaments in a sodium hydroxide trisodium phosphate cleaning solution, followed by a water rinse and the immersion in the wetter solution, followed by water rinse and then followed by an etch in hydrogen peroxide, followed by a commercial palladium chloride/stannous chloride catalytic activator, followed by a hydrochloric acid immersion, followed by commercial autocatalytic copper plating as a first copper plating step, followed by a subsequent copper plating step from a copper cyanide bath, followed by a conventional silver plating step, with appropriate water rinses after each of the plating steps, and finally with an alcohol rinse and drying.

6 Claims, 1 Drawing Figure

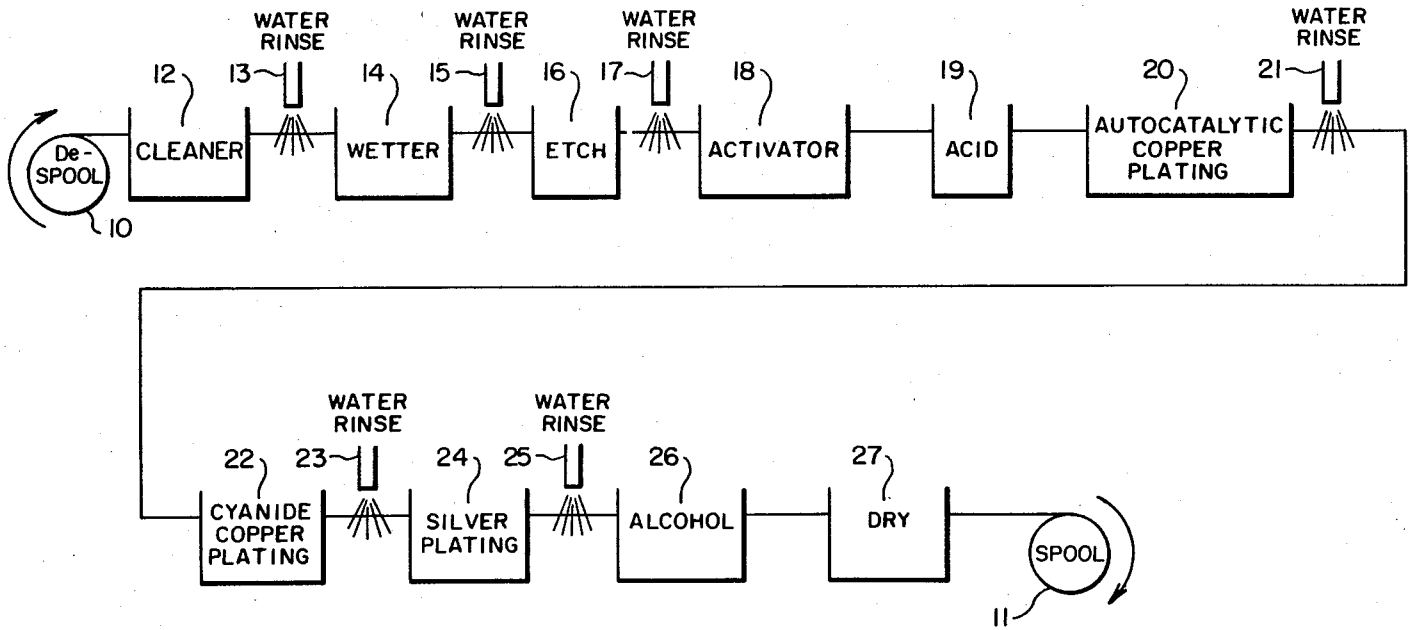
De-SPOOL
10
12
CLEANER
WATER RINSE
13
14
WETTER
WATER RINSE
15
16
ETCH
WATER RINSE
17
18
ACTIVATOR
19
ACID
20
AUTOCATALYTIC COPPER PLATING
WATER RINSE
21
22
CYANIDE COPPER PLATING
WATER RINSE
23
24
SILVER PLATING
WATER RINSE
25
26
ALCOHOL
27
DRY
SPOOL
11

CONTINUOUS PROCESS FOR THE SEQUENTIAL COATING OF POLYESTER FILAMENTS WITH COPPER AND SILVER

BACKGROUND OF THE INVENTION

As far as is known, a process for the coating of polyester with copper followed by silver does not exist in the prior art. The most pertinent disclosure appears to be in U.S. Pat. No. 3,967,010, Maekawa.

SUMMARY OF THE INVENTION

The invention permits the continuous application of copper followed by silver on polyester filaments, usually in the form of multi-filament tows, roving, woven tape or fabric in a relatively short period of time, slightly over 30 minutes. The process involves the use of a wetter solution following the initial cleaning step. Use of this wetter solution is critical to the operation of the process. The wetter solution is a mixture of alcohol, which preferably is isopropyl alcohol, a detergent and a surfactant, where the surfactant is an ethylene oxide and propylene oxide copolymer. The particular surfactant that has been used is sold by BASF Wyandott under the Pluronic series trademark.

It is therefore an object of this invention to coat polyester filaments with sequential coatings of copper and silver.

It is also an object of this invention to coat such filaments in the form of multi-filament polyester tows, roving, woven tape or fabric with sequential coatings of copper and silver so that the resultant product is electrically conductive.

It is a further object of this invention to provide such a process which is a continuous process.

These, together with other objects and advantages of the invention, should become apparent in the details of construction and operation, as more fully described herein and claimed, reference being had to the accompanying drawing forming a part hereof wherein like numerals refer to like parts throughout.

BRIEF DESCRIPTION OF THE DRAWING

The drawing is a flow chart of the processing steps involved in practicing the invention.

DETAILED DESCRIPTION OF THE INVENTION

Referring now more particularly to the drawing, the multi-filament polyester tow, roving, woven tape or fabric is wound on the spool 10 and unwound from the spool 10 by the action of windup spool 11 and continuously moved through the various processing steps at prescribed residence times using conventional sealing techniques.

The first step involves immersing the polyester filaments in the cleaner solution shown at 12. This cleaner solution preferably is a mixture of sodium hydroxide and trisodium phosphate. This step is then followed by a water rinse 13, followed by immersing the filaments in a wetter solution 14 comprising water and isopropyl alcohol containing a detergent and a small amount, in the order of one half to one percent, of ethylene oxide and propylene oxide copolymer surfactant, followed by a water rinse 15. The polyester filaments are then immersed in etching solution 16, preferably containing 30 percent hydrogen peroxide, followed by water rinse 17. The polyester filaments are then immersed in a commercial palladium chloride/stannous chloride catalytic activator 18. The residence time in the cleaner solution 12 usually is about one minute at 50° C., the residence time in the wetter solution 14 is about one minute and the residence time in the hydrogen peroxide etching solution 16 is about three minutes. The residence time in the activator 18 is about three minutes. The polyester filaments then are introduced into a 50 percent hydrochloric acid bath 19 and then directly into the autocatalytic copper plating bath 20 for a period of from five to 20 minutes. This is then followed with a water rinse 21 and then the filaments are introduced into the copper cyanide plating bath 22, which involves a residence time of about two minutes, followed by a water rinse 23. Then the copper-coated filaments are introduced into silver plating bath 24 for from two to four minutes. This bath is a conventional silver cyanide plating bath. There follows a water rinse 25, an alcohol rinse 26, preferably with isopropyl alcohol, drying step 27, and then spooling on spool 11.

The following examples will illustrate the advantages of the invention. In each of these examples, the following steps were followed for the residence time and temperatures noted:

1. Cleaner of sodium hydroxide, trisodium phosphate at 50° C. for one minute.
2. Water rinse.
3. One minute residence in wetter solution comprising a mixture of isopropyl alcohol, a detergent and an ethylene oxide and propylene oxide copolymer surfactant, which surfactant is one percent by volume of the wetter solution.
4. Water rinse.
5. Etch in 30 percent hydrogen peroxide for three minutes.
6. Water rinse.
7. Immerse in commercial palladium chloride/stannous chloride catalytic activator for three minutes.
8. Rinse in 50 percent hydrochloric acid.
9. Deposit copper from a commercial autocatalytic copper solution for from five to 20 minutes.
10. Water rinse.
11. Deposit additional copper over the copper-coated polyester filaments with conventional copper cyanide plating bath for two minutes.
12. Water rinse.
13. Deposit silver over the multi-copper-coated polyester filaments from a conventional silver cyanide bath with a residence time of from two to four minutes.
14. Water rinse.
15. Isopropyl alcohol rinse.
16. Drying.

EXAMPLE 1

Utilizing the above process steps with the filament transport system set to produce the desired residence times in the specific solutions, a polyester woven tape was processed according to the specified steps. Upon immersion in the autocatalytic copper bath, copper deposit appeared within two minutes and the woven polyester became conductive enough after ten minutes to deposit copper from a high-speed copper cyanide bath. The resultant copper deposits were smooth, shiny and exhibited good adherence to the fabric. Upon immersion in a silver cyanide bath, the copper was entirely covered with metallic silver which was smooth and exhibited good adherence.

EXAMPLE 2

The same conditions and substrate were utilized as in Example 1, only the cleaning, wetter solution, and hydrogen peroxide etch were eliminated. Some metallic copper was deposited autocatalytically onto the polyester filaments, but coverage was low and adhesion was extremely poor. This, in turn, caused poor silver deposits.

EXAMPLE 3

The same conditions as in Example 1 were employed except that an aqua regia etch was employed immediately prior to the commercial palladium/stannous chloride catalytic activator step. The results were the same as in Example 2.

It will thus be seen that by practicing this invention, good quality adherent coatings of silver on copper on multi-filament tows, roving, woven tape or fabric of polyester may be obtained.

While this invention has been described in its preferred embodiment, it is appreciated that variations thereon may be made without departing from the true scope and spirit of the invention.

I claim:

1. A method of continuously coating polyester filaments in the form of multi-filament tows, roving, woven tape or fabric with metal comprising the steps of:

immersing said filaments in a cleaning solution, rinsing said filaments with water, immersing said filaments in a wetter solution containing alcohol, a detergent and an ethylene oxide and propylene oxide copolymer surfactant, rinsing said filaments with water, treating said filaments with an etching solution, rinsing said filaments with water, treating said filaments with an activator selected from the group consisting of palladium chloride and stannous chloride, rinsing said filaments with acid, coating said filaments with copper from an autocatalytic copper solution, rinsing said filaments with water, coating said copper coated filaments with additional copper from a copper cyanide bath, rinsing said filaments with water, coating said copper-coated filaments with silver from a silver cyanide bath, rinsing said filaments with water, rinsing said filaments with alcohol, drying said filaments.

2. The method of claim 1 wherein the cleaning solution comprises a mixture of sodium hydroxide and trisodium phosphate.

3. The method of claim 2 wherein said alcohol is isopropyl alcohol.

4. The method of claim 1 wherein said surfactant is from one-half to one percent of said wetter solution.

5. The method of claim 1 wherein said etching solution contains hydrogen peroxide.

6. The method of claim 1 wherein said filaments are rinsed with hydrochloric acid following the treatment with palladium chloride/stannous chloride.

* * * * *